US006571570B1

(12) United States Patent
Phillips

(10) Patent No.: US 6,571,570 B1
(45) Date of Patent: Jun. 3, 2003

(54) EXHAUST DOOR MECHANISM FOR A ROOM AIR CONDITIONER

(75) Inventor: Brian J. Phillips, Smyrna, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 10/064,119

(22) Filed: Jun. 12, 2002

(51) Int. Cl.[7] ..... F25D 23/12
(52) U.S. Cl. ..... 62/262; 62/263
(58) Field of Search ..... 62/262, 263, 408, 62/409

(56) References Cited

U.S. PATENT DOCUMENTS

| | | | | | |
|---|---|---|---|---|---|
| 3,665,727 | A | * | 5/1972 | Mather | 62/262 |
| 3,906,741 | A | | 9/1975 | Terry | 62/262 |
| 3,911,693 | A | * | 10/1975 | Seigler et al. | 62/151 |
| 4,240,264 | A | * | 12/1980 | Nakada et al. | 62/125 |
| 4,524,588 | A | | 6/1985 | Bond | 62/262 |
| 5,010,742 | A | * | 4/1991 | Bolton et al. | 62/262 |
| 5,085,057 | A | * | 2/1992 | Thompson et al. | 62/262 |
| 5,415,011 | A | * | 5/1995 | Gilmore et al. | 62/262 |
| 5,638,693 | A | * | 6/1997 | Baek | 62/262 |
| 5,638,695 | A | * | 6/1997 | Kamio et al. | 62/279 |
| 6,000,234 | A | | 12/1999 | Baek | 62/262 |
| 6,032,479 | A | * | 3/2000 | Choi et al. | 62/262 |
| 6,093,097 | A | * | 7/2000 | Cho | 454/233 |
| 6,155,065 | A | * | 12/2000 | da Silva | 62/262 |
| 6,182,460 | B1 | * | 2/2001 | Hernandez et al. | 62/262 |
| 6,238,023 | B1 | * | 5/2001 | Choi | 312/101 |
| 6,276,157 | B1 | | 8/2001 | Moraes | 62/262 |

* cited by examiner

*Primary Examiner*—William E. Tapolcai
*Assistant Examiner*—Mohammad M. Ali
(74) *Attorney, Agent, or Firm*—Robert O. Rice; John F. Colligan; Stephan Krefman

(57) ABSTRACT

A refrigeration device is provided having an air pressurizing device and a shroud enclosing the air pressurizing device and defining a first air flow path for an air flow generated by the air pressurizing device. The air pressurizing device and the shroud are positioned in a front side of the room air conditioner. A back side of the air conditioner includes air outlets communicating with an exterior of the air conditioner. A second air flow path extends between the first air flow path and the air outlets. A slider member is positioned in the second air flow path such that in a first position the second air flow path is closed to prevent communication between the first air flow path and the air outlets and in a second position of the slider member, the second air flow path is open to allow communication between the first air flow path and the air outlets.

20 Claims, 10 Drawing Sheets

EXHAUST DOOR MECHANISM FOR A ROOM AIR CONDITIONER

BACKGROUND OF THE INVENTION

The present invention relates to room air conditioners and more particularly, to room air conditioners having an exhaust vent.

Room air conditioners typically are positioned in a window or in a through the wall sleeve such that a front part of the air conditioner unit is positioned in a space to be cooled, such as a room, and a back part is exposed to the exterior of the space, typically the outdoors. The interior of the room air conditioner includes a compressor for compressing gaseous refrigerant, a condenser to condense the gaseous refrigerant to a liquid, and to release heat in the process, and an evaporator to allow the refrigerant to evaporate, and to absorb heat in the process. The condenser is positioned in the back part and the evaporator is positioned in the front part. A blower is utilized to draw room air in through an inlet grill, to pass over the evaporator so that heat from the air is given up to the evaporator, and hence cooled, and the air then passes through the blower to pressurize the air, causing it to flow out of the air conditioner through an outlet grill back into the room. Generally, the room air is continuously recirculated from the room and back into the room. Occasionally it is desirable to vent room air to the outdoors through the air conditioner, and in this situation it is known to provide an openable door from the area of the pressurized air to the back part of the air conditioner where it will be permitted to flow out of the air conditioner unit. Oftentimes the provision of such vent doors requires complicated structures comprising many different parts requiring costly assembly of the various parts.

It would be an improvement in the art if a vent door were provided which did not entail the complicated structure required by the prior art.

SUMMARY OF INVENTION

The present invention provides for a vent door formed of a single part arranged in a room air conditioner which can be arranged and held in place without the use of any additional parts such as fasteners, and which permits a user to easily and quickly move the door from a closed position to a closed position and vice versa, and which gives the user a visual indication of the position of the door.

In an embodiment, the vent door is a slide member positioned between an opening in an evaporator air blower shroud, which communicates with an area of high air pressure resulting from the blower and an opening in a wall separating the front side of the room air conditioner from the back side. The slide member has an elongated arm which extends forwardly of a front of the air conditioner where it can be easily grasped by a user of the air conditioner and moved between an open and a closed position. For example, the open position may be where the arm of the slide member is pulled forward from the front of the air conditioner, so that when the door is in the open position, the arm will be protruding a greater extent from the front of the air conditioner than when the door is closed. In this manner, the user is given a visual indication of the position of the door.

To move the door to the closed position, the arm is pushed back into the air conditioner until the movement is stopped by interference between the slide member and the interior components of the air conditioner. Even in this position the arm will protrude slightly from the front of the air conditioner so that the user can grasp the arm to move it to the open position.

The interior components of the air conditioner, such as the blower shroud and the wall separating the front and back portions of the air conditioner can be formed to slidingly receive and guide the slider member so that additional parts and fasteners are not required to maintain the slider member in the correct position.

DETAILED DESCRIPTION

The present invention relates to a room air conditioner which typically is positioned in a window or in a through the wall sleeve such that a front part of the air conditioner unit is positioned in a space to be cooled and a back part is exposed to the exterior of the space. While the present invention can be utilized in many different types of room air conditioners, it is shown and described in one particular room air conditioner unit, for illustrative purposes, however the scope of the claims should not be limited to the embodiment illustrated and described.

Figure 1:
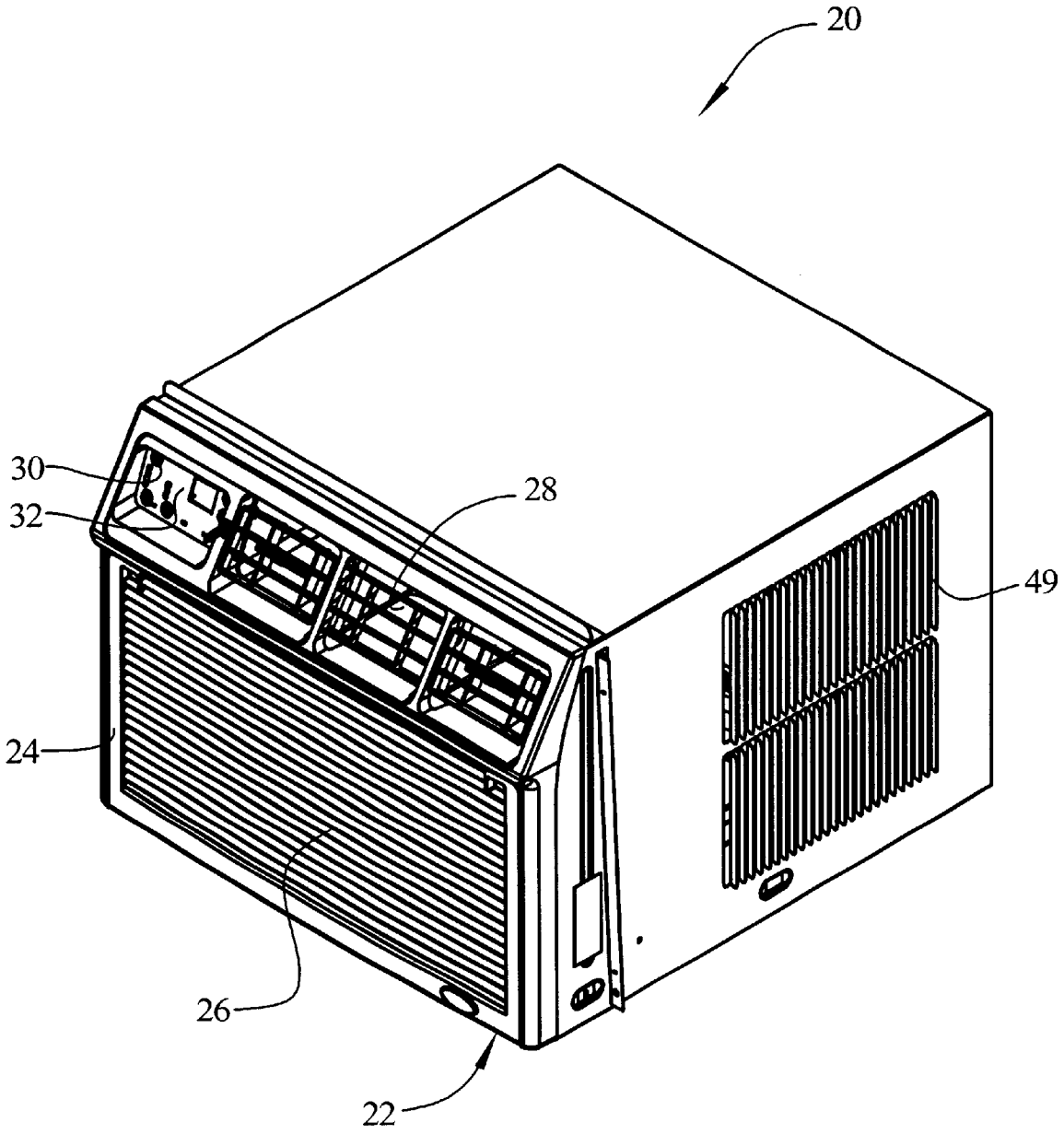
FIG. 1 is a perspective view of a room air conditioner in which the present invention can be utilized.
Figure 2:
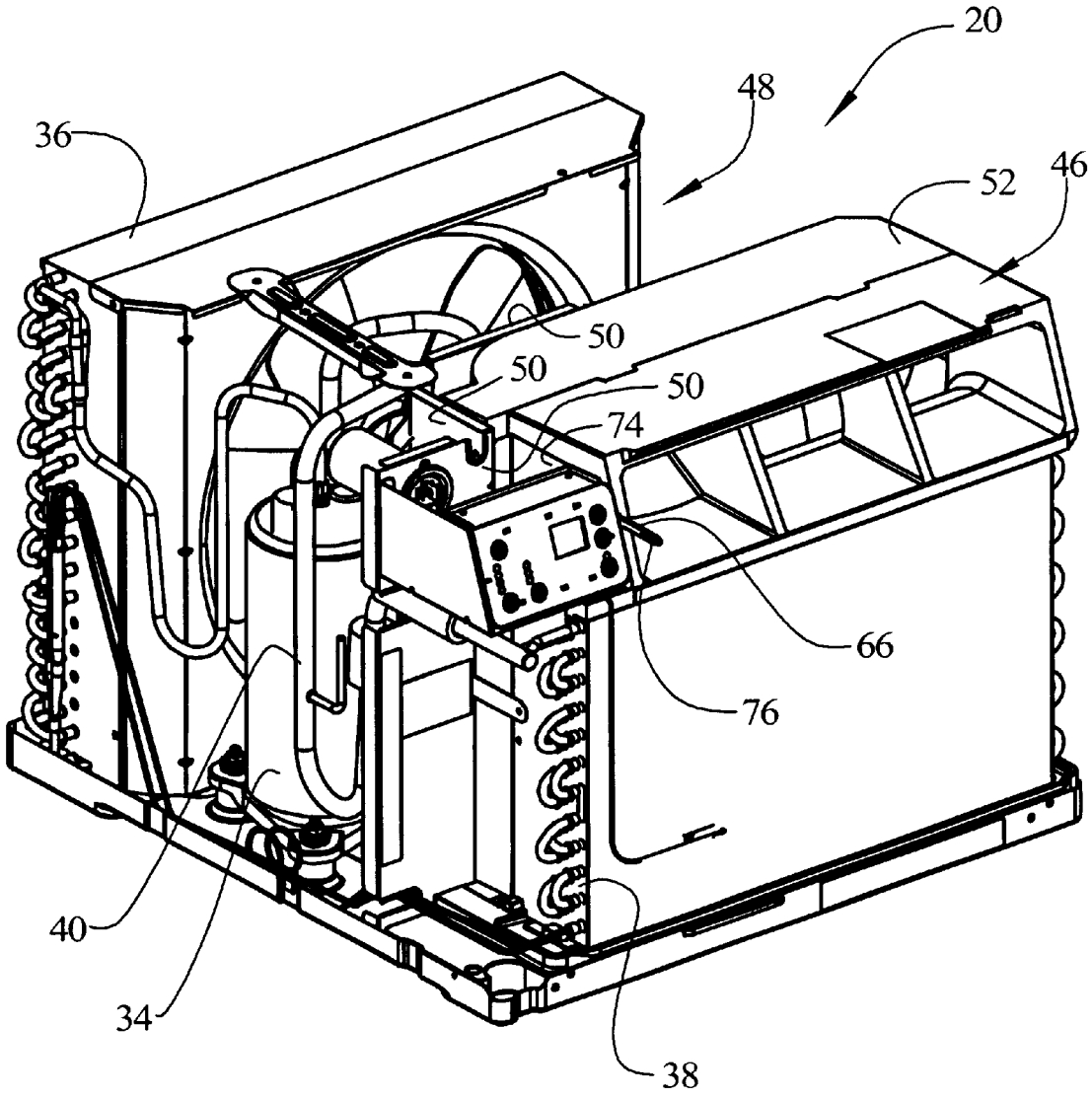
FIG. 2 is a perspective view of the room air conditioner of FIG. 1, with the outer shroud removed to expose interior components.
Figure 3:
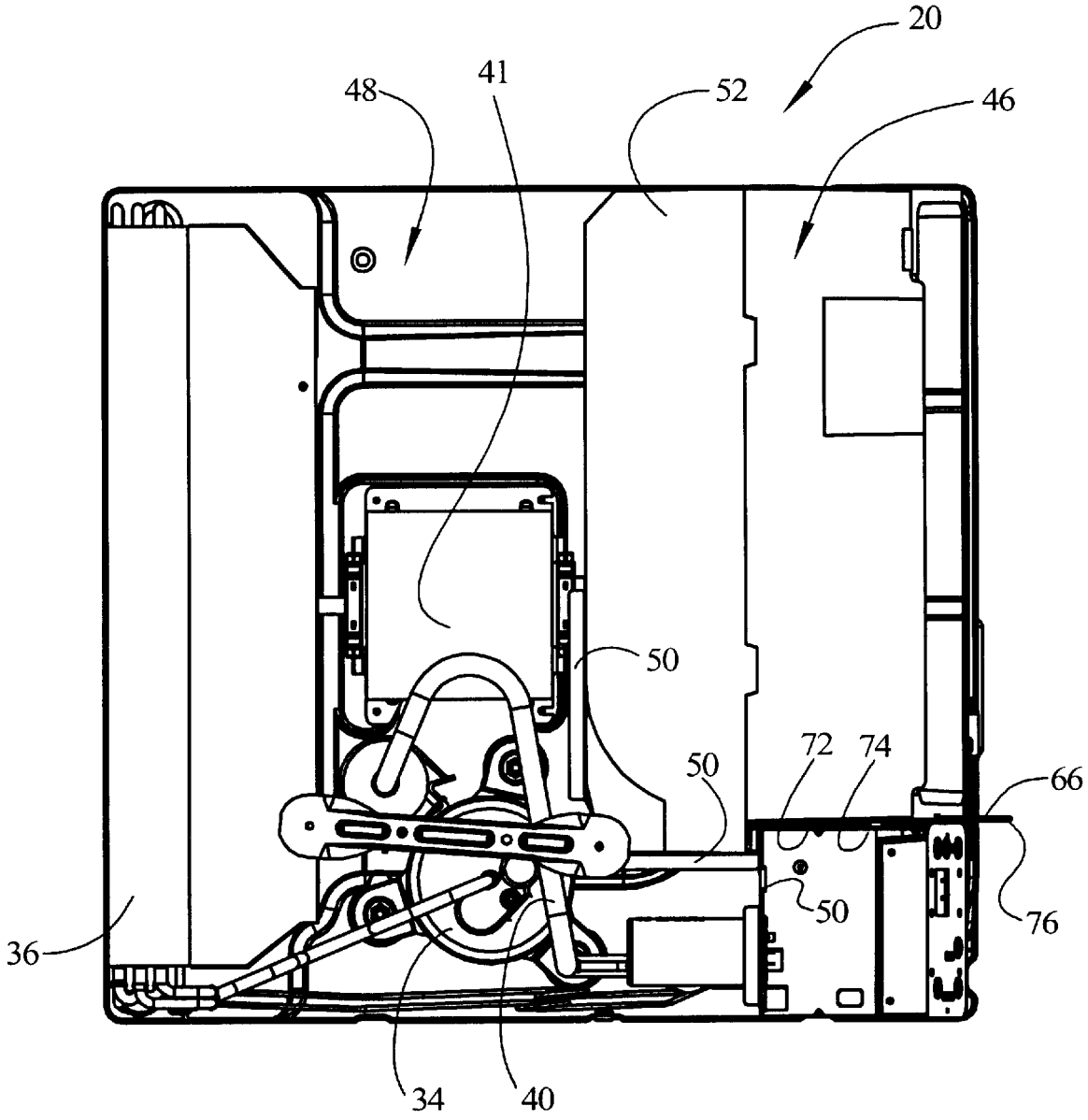
FIG. 3 is a plan front view of the interior of the room air conditioner of FIG. 1.
Figure 4:
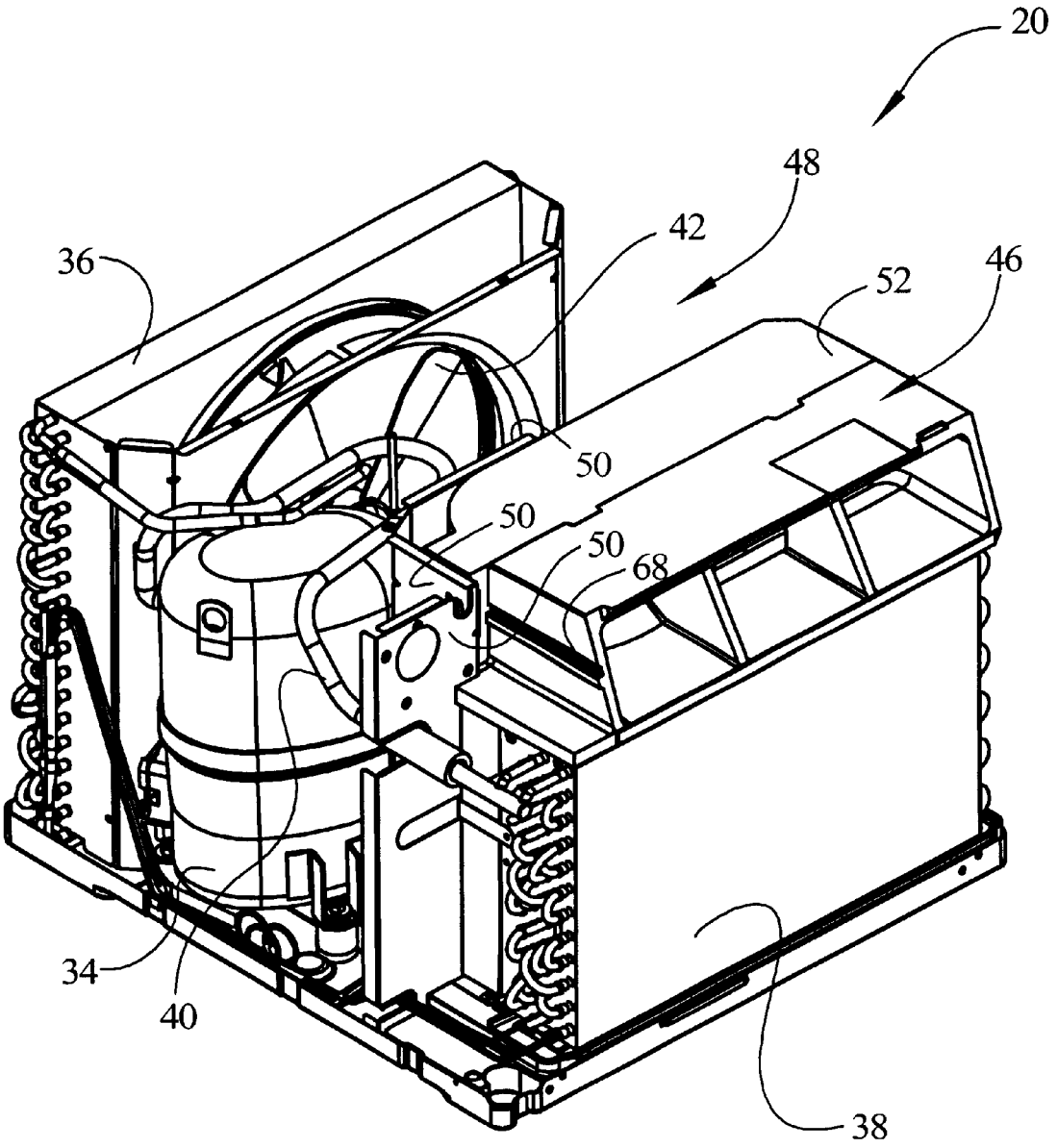
FIG. 4 is a perspective view of the room air conditioner of FIG. 2, with further interior components removed.
Figure 5:
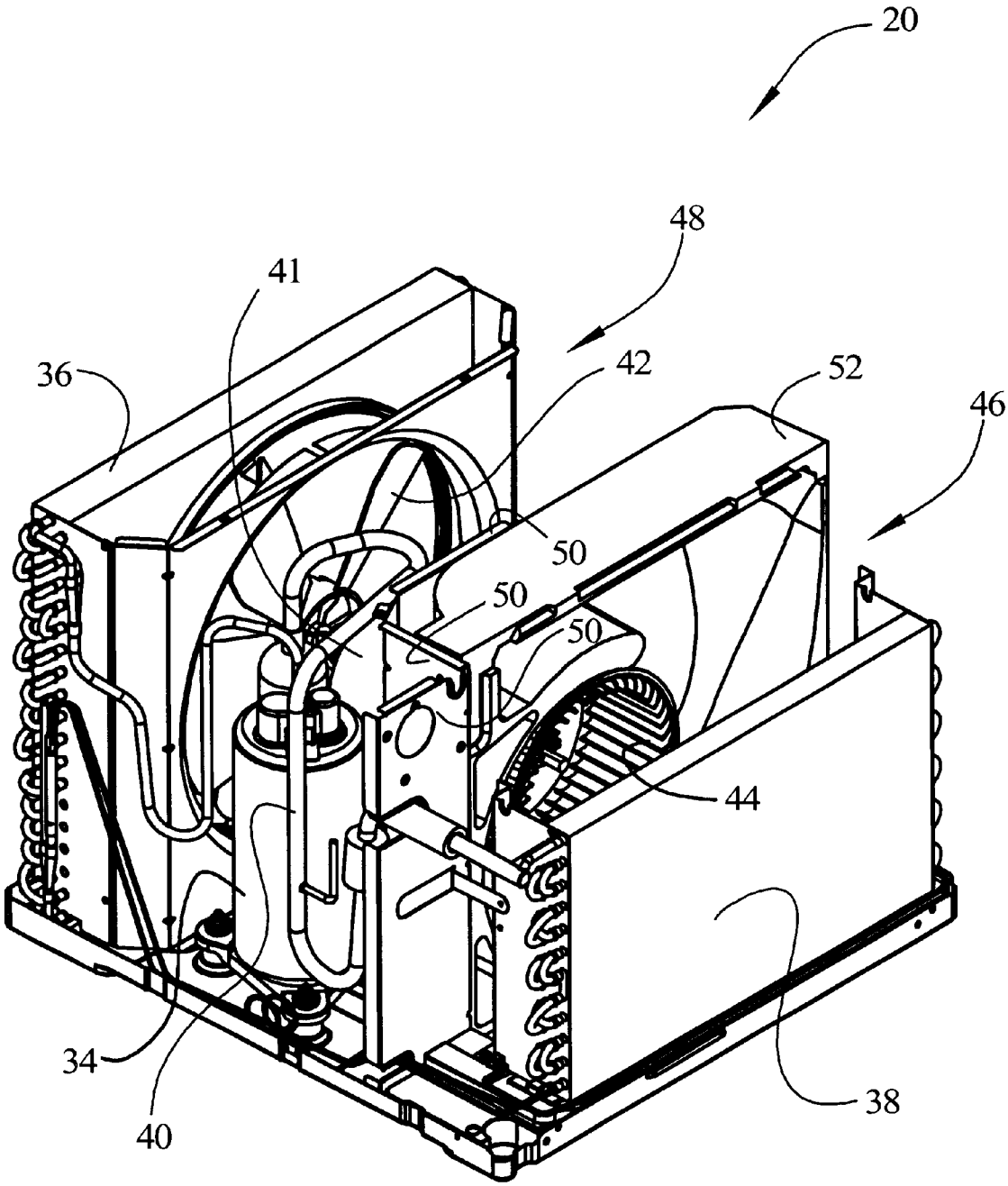
FIG. 5 is a perspective view of the room air conditioner of FIG. 4, with further interior components removed.

In FIG. 1 there is illustrated a room air conditioner 20 embodying the principles of the present invention which comprises a cabinet portion 22 facing the interior of a space to be cooled, including a front panel 24 with an air flow inlet grill 26 and an air flow outlet grill 28. A plurality of controls 30 are arranged on a control panel 32 located on the front panel 24. Room air is pulled into the air flow inlet grill 26 and discharged back into the room through the air flow outlet grill 28.

In FIGS. 2–5, some of the interior components of the room air conditioner 20 are illustrated including a compressor 34, a condenser coil 36 and an evaporator coil 38, all interconnected by refrigeration lines 40 as is known in the art. A single motor 41 is used to drive a condenser fan 42 and an evaporator blower wheel 44, also as is known.

The air conditioner 20 is divided into a front part 46 which contains the evaporator coil 38 and the evaporator blower wheel 44, and a back part 48 which contains the condenser coil 36, the compressor 34 and air outlets 49 (FIG. 1). A divider wall 50 is provided between the front part 46 and the back part 48, and generally there is no air flow between the front part 46 and the back part 48.

Figure 8:
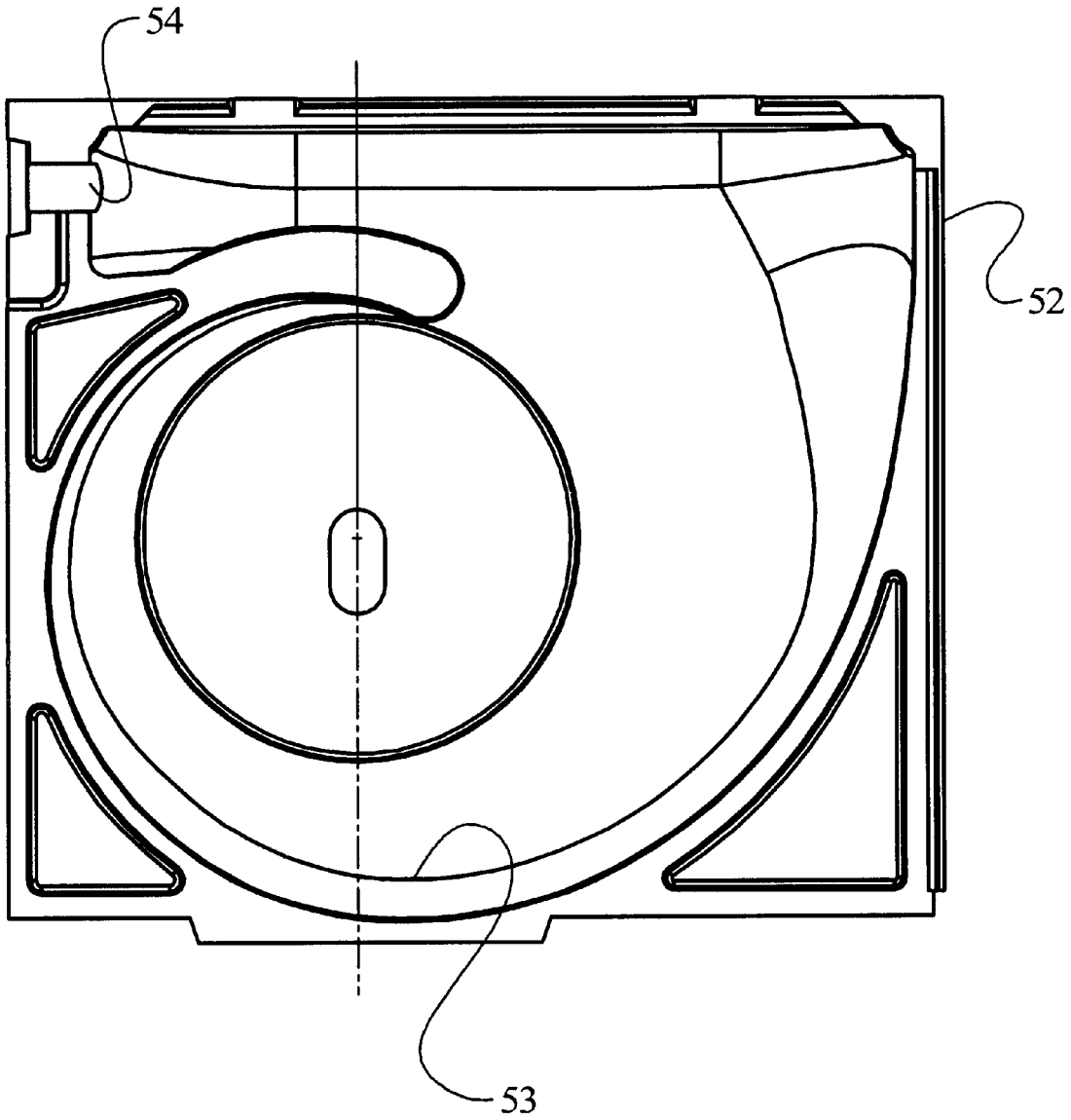
FIG. 8 is a front elevational view of an air shroud used in an embodiment of the present invention.
Figure 9:
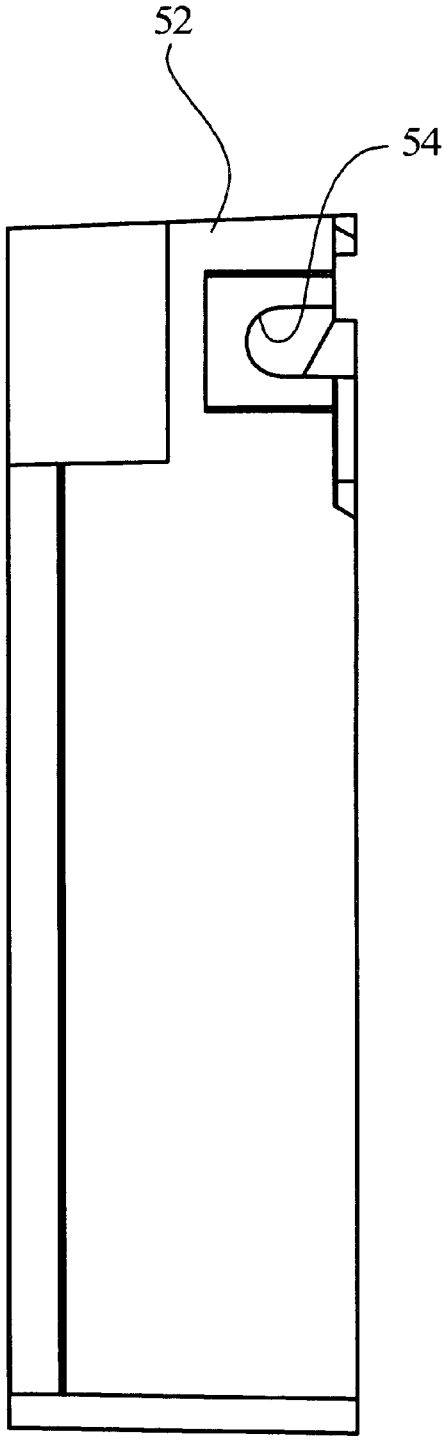
FIG. 9 is an end elevational view of the air shroud of FIG. 8.
Figure 10:
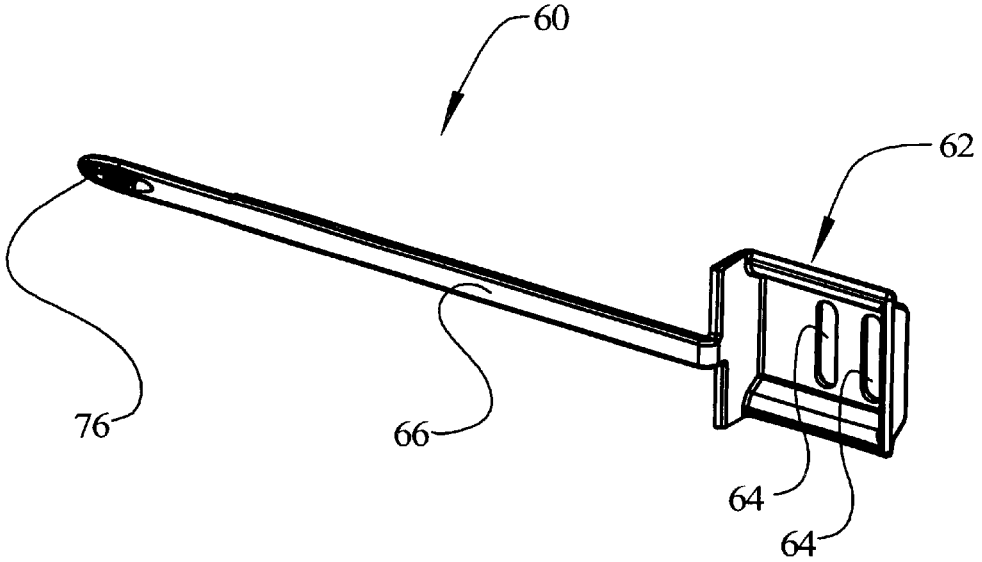
FIG. 10 is a perspective view of the exhaust door mechanism.
Figure 11:
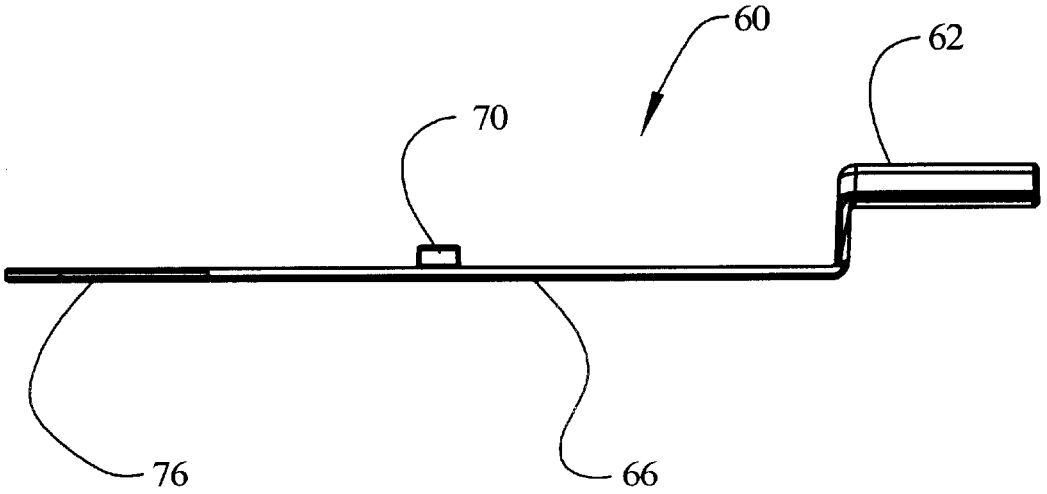
FIG. 11 is a plan view of the exhaust door mechanism of FIG. 10.

The evaporator blower wheel 44 is enclosed in a shroud 52 which defines a first air flow path which extends through the evaporator coil 38 and into the blower wheel where the air is pressurized an is directed to a scroll shaped passage 53 (FIG. 8) leading to the air outlet grill 28. The shroud 52 may be formed as a single piece unit or a multiple piece unit and abuts against the divider wall 50. The shroud 52 includes an opening 54 (FIGS. 8 and 9) aligned with a pair of openings 56 in the divider wall 50 to define a second flow path extending between the first flow path (in the interior of the shroud 52) and the air outlets 49 (in the back part 48).

Figure 6:
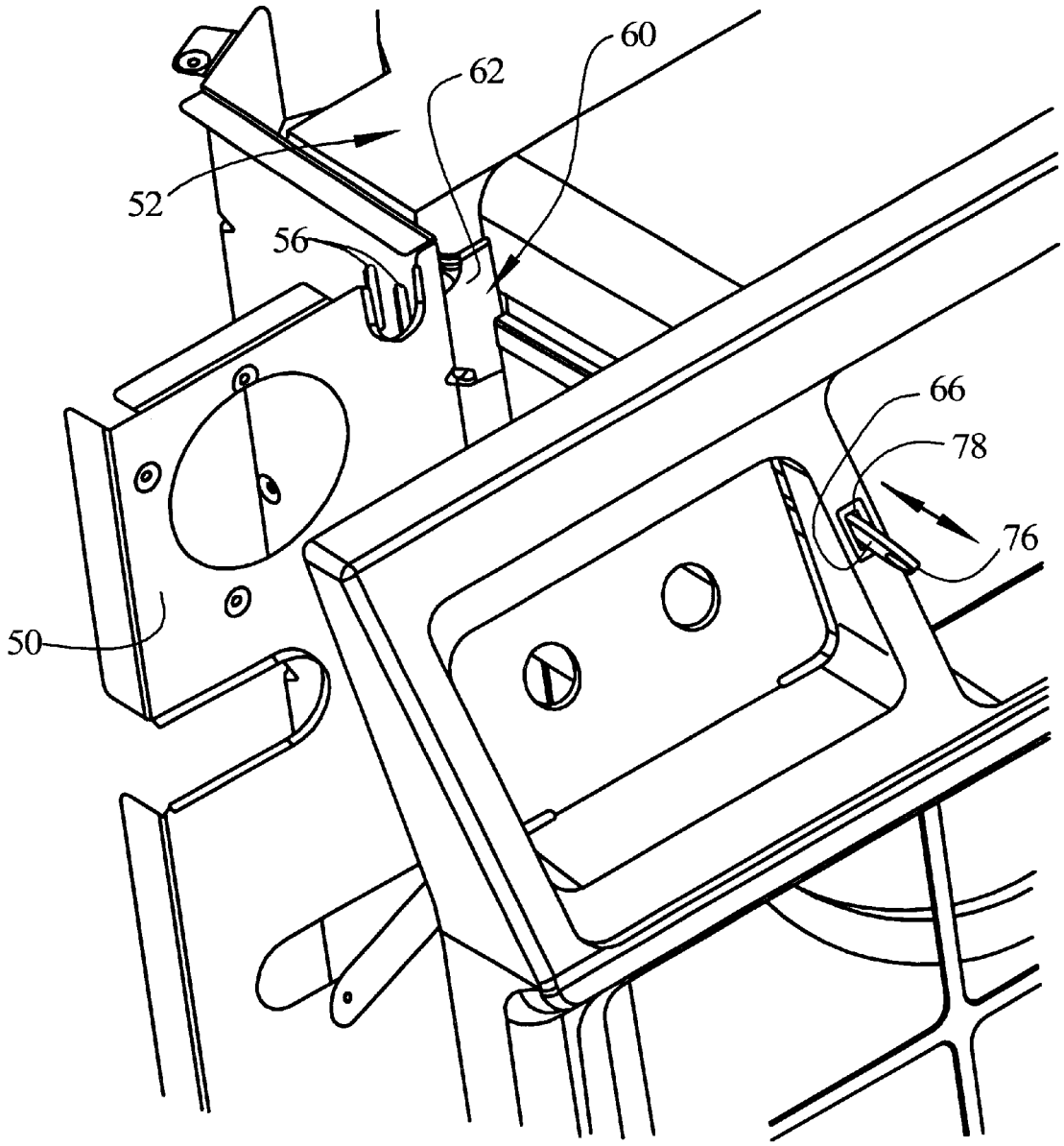
FIG. 6 is a partial front perspective view of the exhaust door area of a room air conditioner embodying the principles of the present invention.
Figure 7:
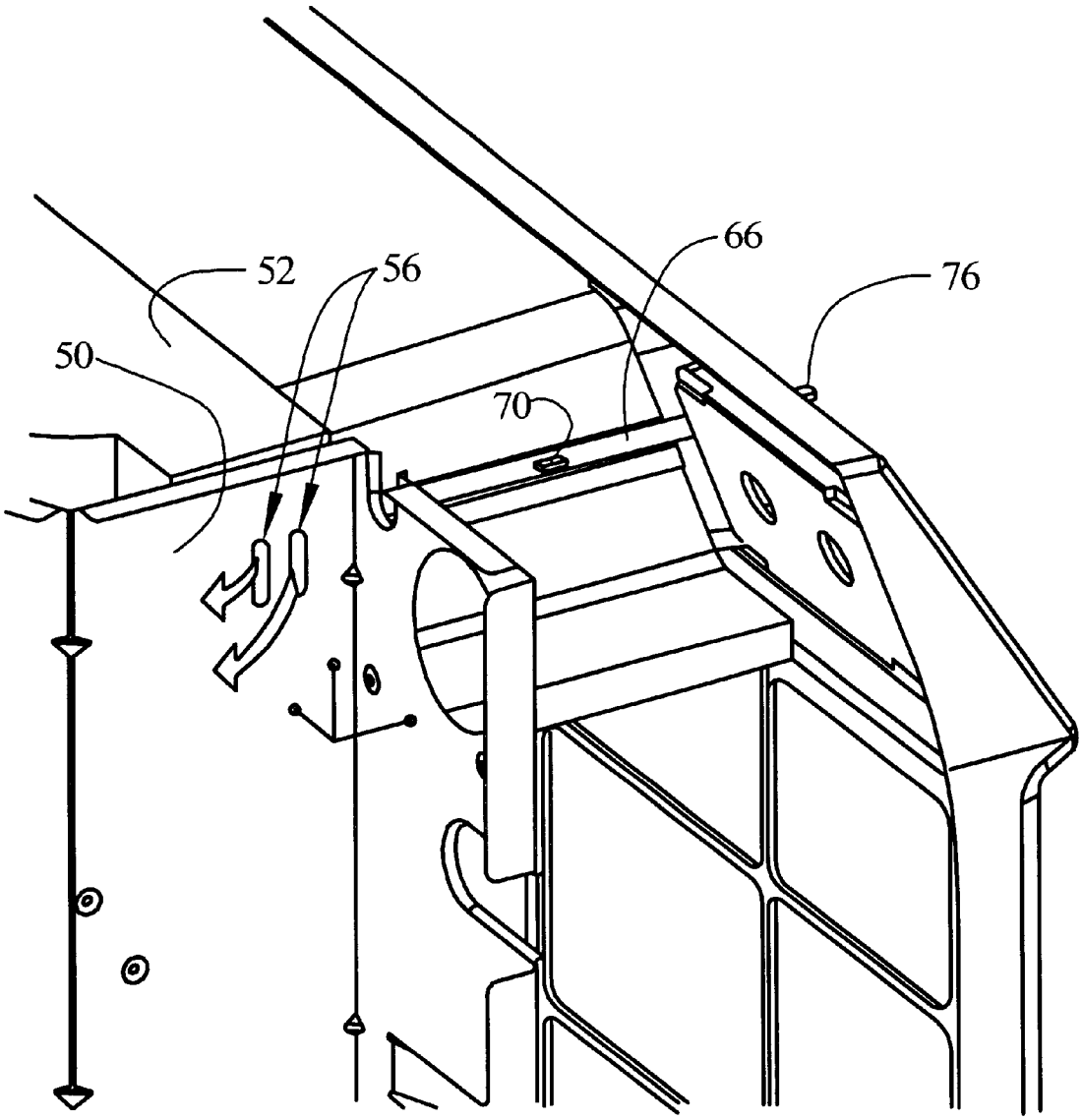
FIG. 7 is a partial rear perspective view of the exhaust door area of a room air conditioner embodying the principles of the present invention.

An exhaust door mechanism comprises a slider member 60 (FIGS. 6 and 7) is provided which has a door portion 62 which is interposed between the divider wall 50 and the shroud 52 in the area of the openings 54,56. The door portion has a pair of openings 64 which conform in size and shape to the openings 56 in the divider wall 50 so that the door portion 62 can be moved to align the openings 64 in the door portion 62 with the openings 56 in the divider wall 50. The door portion 62 can also be moved so that the openings 64 are out of alignment with the openings 56 in the divider wall 50 to prevent air from flowing between the opening 54 in the shroud 52 and the openings 56 in the divider wall 50.

The slider member 60 also has an elongated arm portion 66 extending from the door portion 62 which protrudes from the front of the air conditioner 20 at the front pull 24. In the embodiment illustrated, the shroud 52 includes a channel 68 for receiving and guiding the arm portion 66 of the slider member. An interference portion in the form of a tab 70 protrudes from the arm portion 66 in a direction perpendicular to a sliding direction of the arm portion which can extend into a slot 72 formed in a wall 74 in the air conditioner 20 to limit the sliding movement of the slider member 60 and to provide a positioning of the door portion 62 either to place the openings 54, 56 and 64 in register or to prevent an alignment of the openings.

As shown in the embodiment illustrated, the slider member 60 is held in the air conditioner 20 without the use of any additional fasteners. The door portion 62 is slidingly captured between the shroud 52 and the divider wall 50. The arm portion 66 is carried and guided in the channel 68 and a free end 76 of the arm portion protrudes through an opening 78 in the front panel 24.

When a user grasps the free end 76 of the slider member 60 and pulls it forwardly from the front of the air conditioner, the openings 54, 56 and 64 will align and will allow the pressurized air in the shroud to flow out through the openings to the air outlets 49. With the free end 76 of the arm portion extended outwardly in the exhaust position, the user is presented with a visual indication of the position of the slider member 60. When the user pushes the free end 76 back into the air conditioner 20, the openings will be moved out of alignment and the second flow path will be cut off preventing exhaust of air from the air conditioner. The free end 76 will still protrude a bit from the front of the air conditioner 20, to allow the user to grasp the free end, but the minimal extension will provide a visual indication to the user that the door portion 62 is in the non-exhaust position.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

What is claimed is:

1. A room air conditioner having an exhaust door mechanism comprising:

a front side of said air conditioner including an evaporator, an air blower and a shroud enclosing said air blower and defining an air flow path for an air flow generated by said air blower, a back side of said air conditioner including a compressor and a condenser, a divider wall positioned between said front side said back side, a front grill at a front of said front side, an opening in said shroud adjacent to said divider wall, an opening in said divider wall aligned with said opening in said shroud, a slider member positioned between said opening in said shroud and said opening in said divider wall such that in a first position of said slider member, said openings are prevented from communicating with each other by said slider member and in a second position of said slider member, said openings are permitted to communicate with one another.

2. A room air conditioner according to claim 1, wherein said shroud includes a channel formed therein to receive a portion of said slider member to guide and position said slider member.

3. A room air conditioner according to claim 1, wherein said slider member includes an arm portion which extends through said front grill to be graspable by a user of said air conditioner.

4. A room air conditioner according to claim 1, wherein said slider member has an opening therein which is moved in and out of register with said openings in said shroud and said divider wall in said second and first positions, respectively.

5. A room air conditioner according to claim 1, wherein said slider member includes an interference portion which engages with a portion of said air conditioner to stop a sliding movement of said slider member in said first position and in said second position.

6. A room air conditioner according to claim 5, wherein said interference member comprises a tab protruding from said slider member in a direction perpendicular to a sliding motion of said slider member.

7. A room air conditioner according to claim 6, wherein said air conditioner includes a wall with a slot to receive said tab.

8. A room air conditioner according to claim 1, wherein said slider member is held in said air conditioner without the use of any fastener members.

9. A room air conditioner according to claim 1, wherein at least a portion of said slider member is slidingly captured between said shroud and said divider wall.

10. A room air conditioner according to claim 1, wherein said slider member includes a plurality of openings therethrough to selectively align with said openings in said shroud and said divider wall in said second position.

11. A room air conditioner comprising:

an air pressurizing device and a shroud enclosing said air pressurizing device and defining a first air flow path for an air flow generated by said air pressurizing device, said air pressurizing device and said shroud being positioned in a front side of said room air conditioner, a back side of said air conditioner with air outlets communicating with an exterior of said air conditioner, a second air flow path extending between said first air flow path and said air outlets, a slider member positioned in said second air flow path such that in a first position of said slider member, said second air flow path is closed to prevent communication between said first air flow path and said air outlets and in a second position of said slider member, said second air flow path is open to permit said first air flow path and said air outlets to communicate with one another.

12. A room air conditioner according to claim 11, wherein said shroud includes a channel formed therein to receive a portion of said slider member to guide and position said slider member.

13. A room air conditioner according to claim 11, wherein said air conditioner includes a front grill positioned on a front of said front side and said slider member includes an arm portion which extends through said front grill to be graspable by a user of said air conditioner.

14. A room air conditioner according to claim 11, wherein said slider member has an opening therein which is moved in and out of register with said second air flow path in said second and first positions, respectively.

15. A room air conditioner according to claim 11, wherein said slider member includes an interference portion which engages with a portion of said air conditioner to stop a sliding movement of said slider member in said first position and in said second position.

16. A room air conditioner according to claim 15, wherein said interference member comprises a tab protruding from said slider member in a direction perpendicular to a sliding motion of said slider member.

17. A room air conditioner according to claim 16, wherein said air conditioner includes a wall with a slot to receive said tab.

18. A room air conditioner according to claim 11, wherein said slider member is held in said air conditioner without the use of any fastener members.

19. A room air conditioner having an exhaust door mechanism comprising:

a front side of said air conditioner including an evaporator, an air blower and a shroud enclosing said air blower and defining an air flow path for an air flow generated by said air blower, a back side of said air conditioner including a compressor and a condenser, a divider wall positioned between said front side said back side, a front grill at a front of said front side, an opening in said shroud adjacent to said divider wall, an opening in said divider wall aligned with said opening in said shroud, a slider member positioned between said opening in said shroud and said opening in said divider wall and having an opening therein such that in a first position of said slider member, said openings are prevented from communicating with each other and in a second position of said slider member, said openings are permitted to communicate with one another, said slider member including a tab which engages with a slot in a wall in said air conditioner to stop a sliding movement of said slider member in said first position and in said second position, said slider member including an arm portion which extends through said front grill to be graspable by a user of said air conditioner, said shroud including a channel formed therein to receive a portion of said slider member to guide and position said slider member, at least a portion of said slider member being slidingly captured between said shroud and said divider wall, and said slider member being held in said air conditioner without the use of any fastener members.

20. A room air conditioner according to claim 19, wherein said slider member includes a plurality of openings therethrough to selectively align with said openings in said shroud and said divider wall in said second position.

* * * * *